United States Patent [19]

Arndt et al.

[11] 4,182,533

[45] Jan. 8, 1980

[54] SEAT BACKREST HAVING AN ADJUSTABLE LUMBAR SUPPORT

[75] Inventors: O. Harold Arndt, Milwaukee; William L. Wilton, Waukesha, both of Wis.

[73] Assignee: UOP Inc., Des Plaines, Ill.

[21] Appl. No.: 973,200

[22] Filed: Dec. 26, 1978

[51] Int. Cl.[2] ..... A47C 7/46; A47C 3/00

[52] U.S. Cl. ..... 297/284

[58] Field of Search ..... 297/284, 361; 267/89

[56] References Cited

U.S. PATENT DOCUMENTS

| | | | |
|---|---|---|---|
| 2,550,831 | 5/1951 | Lingenfelter | 297/284 |
| 3,550,953 | 12/1970 | Neale | 297/284 |
| 3,565,482 | 2/1971 | Blodee | 297/284 |
| 3,807,794 | 4/1974 | Beyer | 297/284 |
| 3,948,558 | 4/1976 | Obermeier et al. | 297/284 |

*Primary Examiner*—Francis K. Zugel

*Attorney, Agent, or Firm*—James R. Hoatson, Jr.; Barry L. Clark; William H. Page, II

[57] ABSTRACT

A seat backrest having an upholstered cushion portion supported by a rigid frame portion includes means to produce a desired supporting contour in the lumbar region of the seat occupant. The contour-producing means includes a lumbar pad, resiliently biased pivoted arm members connecting the lumbar pad to the frame through a toggle linkage, and handle means operable from the side of the backrest for adjustably positioning the lumbar pad in a plurality of fixed positions forward of the frame.

9 Claims, 3 Drawing Figures

SEAT BACKREST HAVING AN ADJUSTABLE LUMBAR SUPPORT

BACKGROUND OF THE INVENTION

The present invention relates to vehicle seats and particularly to seat backrests of the type which include internal structures for selectively adjusting the seat cushion contour to provide varying degrees of lumbar support to a seat occupant.

The desirability for providing support for the lumbar region of the back of a seat occupant has long been recognized and various patents, including U.S. Pat. Nos. 3,807,794; 3,890,000; 3,948,558 and 3,973,797 disclose structures for permitting a fore and aft adjustment of an internal lumbar pad within a back cushion.

SUMMARY

It is among the objects of the present invention to provide an adjustment lumbar support for a seat back which is simple to operate by a seated occupant and which provides positive positioning of the lumbar support.

The above and other objects are attained by the apparatus of the present invention wherein a lumbar pad member is supported for generally fore and aft movement by a pair of spring wire support arms which pivot about supports which are normally fixed relative to the seat back frame. The lumbar pad is resiliently biased to its extended position by a rigid toggle link which is pivoted at one end to the lumbar pad and the pair of support arms and at its other end to a vertically adjustable link which is movable in a guide channel which is integral with the seat back frame. The vertically adjustable link is actuated by a connecting link which is pivoted to a pivotally mounted handle member. The compactness of the structure permits its use in combination with existing seat back frames with only minor modifications.

DESCRIPTION OF THE PREFERRED EMBODIMENT

Figures 1, 2, 3:
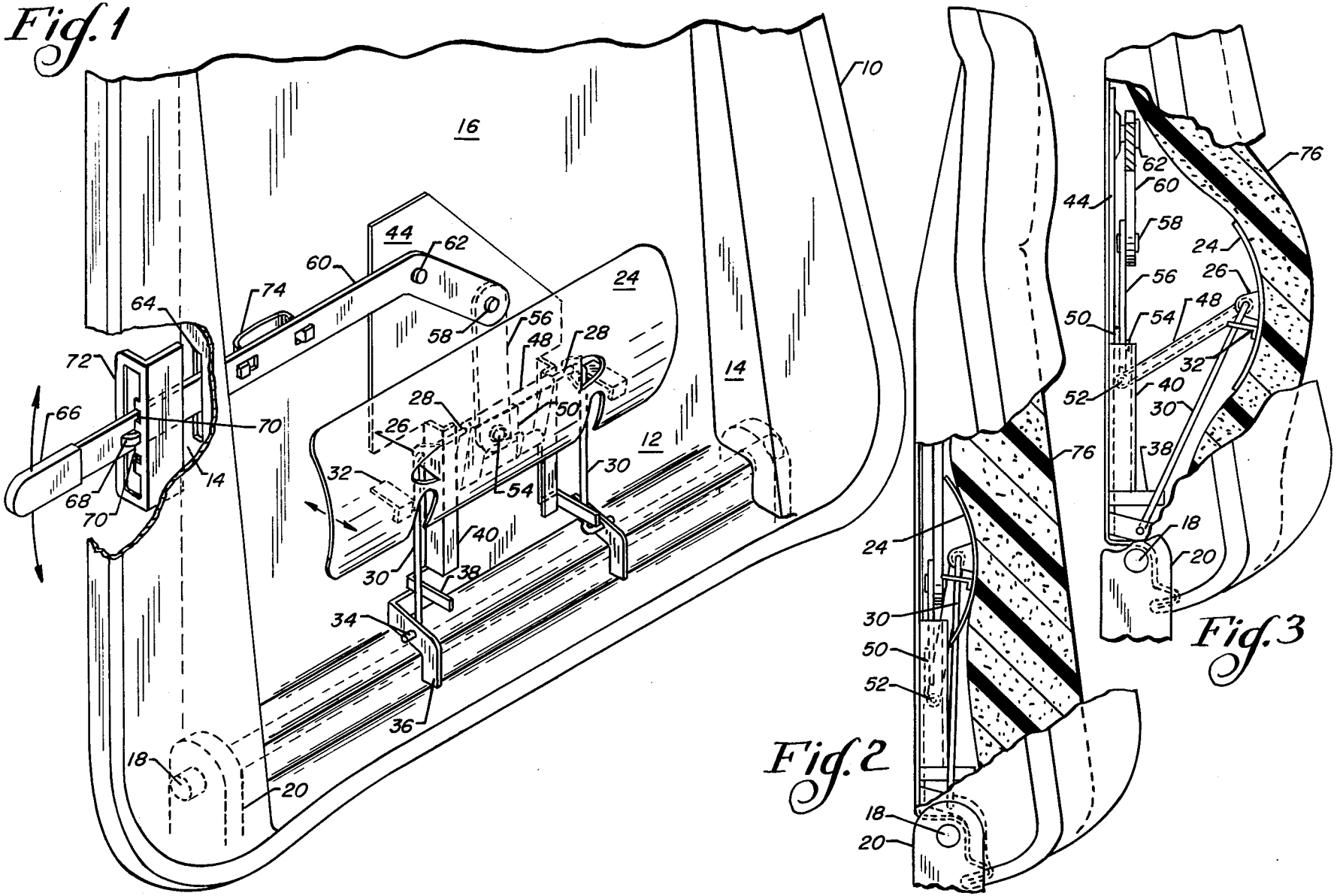
FIG. 1 is a fragmentary perspective view of a seat back frame member incorporating the lumbar assembly in its intermediate adjustment position with the seat back cushion removed for clarity.
FIG. 2 is a partially broken away, partially sectioned, side view of a seat back with the lumbar support structure in its recessed, inoperative configuration.
FIG. 3 is a partially broken away, partially sectioned, side view of a seat back with the lumbar support structure in its full forward, operative position.

Referring to FIG. 1, a formed metal seat back frame 10 can be seen as having a recessed pocket portion 12 defined by side portions 14 and a back portion 16. A pivot 18 is indicated as passing behind the seat back frame 10 and is used to pivotally mount the seat back by means of mounting angles (not shown) to brackets 20 formed on the seat base (not shown). A lumbar pad member 24 is preferably formed of metal and has struck out or welded on hinge portions 26 which capture the upper free ends 28 of a pair of formed spring wire arm members 30. A pair of stop members 32 are integrally attached to the lumbar pad 24 to retain the arm ends 28 in place. The lower ends 34 of the arms 30 are pivotally mounted in apertures in integral support bracket portions 36 and retained therein by integral retaining portions 38. The bracket portions 36, the retaining portions 38 and a pair of vertical guide channel portions 40 are all preferably formed by being bent out of base plate 44 which is welded to or otherwise fastened to the back portion 16. Fore and aft movement of the lumbar pad 24 along the pivot path of the end portions 28 of the pivoted arm members 30 is controlled by a plurality of levers and links connected by pivot pins. Starting at the lumbar pad 24, a wide, generally flat pivot link 48, which preferably has integrally formed strengthening ribs, has a horizontal hollow hinge portion at its outer end which receives the bent end portions 28 of the support arms 30. The inner or lower end of the link 48 also has horizontal hollow hinge portions which cooperate with complementary hinge portions on a vertically movable link 50 and are pivoted thereto by a hinge pin 52. The hinge in 52 extends axially outwardly from the hinge portions and is captured under the channel portions 40 which restrict the pin 52 and link 50 to movement in a vertical plane parallel to the plate 44. A pivot pin 54 extends horizontally from the vertical link 50 and is engaged by a connecting link 56 which is pivoted by a pivot pin 58 to the inner end of handle lever 60. The handle lever 60 is pivoted intermediate its ends to a pivot pin 62 carried by the base plate 44. Preferably, retaining rings are provided on each pin. The handle lever 60 passes through an opening 64 in one side wall portion 14. It has a handle grip 66 on its outer end and an integral projection portion 68 which is adapted to be moved into contact with a series of retaining notches 70 formed on a bracket 72 welded to the frame 10. A spring 74 carried by the lever 60 bears against the back portion 16 to bias the projection 68 into one of the notches 70 but permits the projection to be moved rearwardly of the notches and then up or down to vary the in and out position of the lumbar pad 24. When the handle 66 is raised to its highest position the lumbar pad 24 will be in its collapsed position shown in FIG. 2. When the handle 66 is in its lowest position, the lumbar pad 24 will be in its extreme forward position illustrated in FIG. 3 in which it forces the padding layer 76 outwardly towards the lumbar region of a seat occupant. By experimentation with different adjustment positions, a particular seat occupant can achieve the degree of lumbar support with which he feels most comfortable.

Although the arms 30 are retained by elements 38 and 32 throughout their operative range of movement, they are easily assembled initially by not immediately attaching pin 58 to link 56. This permits hinge pin 52 and link 48 to be raised above the channels 40 and the lumbar pad 24 to be moved far forwardly of its FIG. 3 position where the arms 30 will clear the elements 32 and 38.

We claim as our invention:

1. In a seat backrest having a rigid rearwardly positioned frame member and a forwardly positioned resilient upholstered cushion member attached thereto, the improvement comprising a lumbar pad pivotally mounted on a pair of arms which are pivoted relative to the frame member about an axis which is fixedly mounted relative to said frame member; a first link member pivotally attached at one end to said lumbar pad; a second link member pivotally attached to said first link member at the opposite end thereof; guide means attached to said frame member for restricting the movement of said opposite end of said first link member to a plane generally parallel to the plane of the frame member; a rigid elongated actuating lever having a handle portion at one end readily accessible to an occupant of the seat, said actuating lever being pivoted at one point along its length relative to said frame member, said actuating lever being connected at another point along its length to said second link member so that movement of said lever about said one point will cause said first and second link members to move up and down relative to said guide means and frame member and thereby cause said lumbar pad to move toward said frame member or toward said cushion member; and detent means for selectively locking said actuating lever in various positions in its range of movement.

2. The seat backrest of claim 1 wherein each of said pair of arms are formed from a single length of spring wire, with the ends of the wire being bent at right angles to the intermediate portion to form pivot axes for pivotally mounting said arm to the lumbar pad and to the first link member at one end and to the frame member at its other end.

3. The seat backrest of claim 2 wherein said guide means comprises a pair of facing channel portions which guide and capture the free ends of a hinge pin to which said first and second link members are hingedly mounted.

4. The seat backrest of claim 3 wherein said second link member extends generally vertically upwardly, between and parallel to said channel portions and is pivotally mounted at its upper end to one of a connecting link which is connected at its other end to the end of said actuating lever which is most remote from said handle portion.

5. The seat backrest of claim 4 wherein said channel portions of said guide means are formed by bending portions of a base mounting base forwardly of a flat plane portion thereof which is welded to the frame member, said base mounting plate also being bent forwardly to form apertured mounting bracket portions for pivotally mounting said other ends of each of said pair of arms.

6. The seat backrest of claim 5 wherein said base mounting plate further includes forwardly formed stop portions for retaining said pair of arms in their respective apertured mounting bracket portions.

7. The seat backrest of claim 6 wherein said base mounting plate further includes an integral pivot pin portion for pivoting said actuating lever relative to said frame member.

8. The seat backrest of claim 1 wherein said detent means comprises a notched bracket having a plurality of spaced notches adapted to be selectively engaged by an integral projection on said actuating lever.

9. The seat backrest of claim 8 wherein said actuating lever has a spring member mounted intermediate said integral projection and said one point along its length to bias said lever away from said frame member so as to force said integral projection into a selected one of said spaced notches, said spring member being compressible to free said projection from said notch by applying pressure to said handle portion.

* * * * *